US006745788B1

(12) United States Patent
Brown

(10) Patent No.: US 6,745,788 B1
(45) Date of Patent: Jun. 8, 2004

(54) TENT WITH A PET ENTRANCE

(75) Inventor: Todd A. Brown, Moon Township, PA (US)

(73) Assignee: Dick's Sporting Goods, Inc., Pittsburgh, PA (US)

( * ) Notice: Subject to any disclaimer, the term of this patent is extended or adjusted under 35 U.S.C. 154(b) by 15 days.

(21) Appl. No.: 10/167,782

(22) Filed: Jun. 10, 2002

(51) Int. Cl.[7] ..... E04H 15/58; E06B 5/00

(52) U.S. Cl. ..... 135/117; 160/180; 160/DIG. 8; 49/169; 119/484; 119/501

(58) Field of Search ..... 135/117, 92, 93, 135/901, 124; 160/180, DIG. 8; 49/169; 119/484, 498, 501

(56) References Cited

U.S. PATENT DOCUMENTS 932,909 A * 8/1909 Saunders
1,123,657 A * 1/1915 Bache
3,052,249 A * 9/1962 Seaman et al.
3,690,299 A * 9/1972 Johnson
3,739,536 A * 6/1973 Ward
4,053,007 A * 10/1977 Griffith
4,164,829 A * 8/1979 Sadler
4,231,289 A * 11/1980 Domicent
4,334,573 A * 6/1982 Hackman et al.
4,788,934 A * 12/1988 Fetter
4,823,824 A * 4/1989 Smith
4,838,293 A * 6/1989 Novak
5,117,890 A * 6/1992 Taylor et al.
5,240,021 A * 8/1993 Snodgrass
5,394,897 A * 3/1995 Ritchey et al.
5,400,541 A * 3/1995 Ennamorato et al.
5,535,804 A * 7/1996 Guest
5,592,960 A * 1/1997 Williams
5,649,500 A * 7/1997 Klavemann et al.
6,019,112 A * 2/2000 Matlock
6,029,609 A * 2/2000 Bahar et al.
6,164,013 A * 12/2000 Rammsey
6,394,035 B1 * 5/2002 Hill
6,401,663 B1 * 6/2002 Meier
6,450,186 B1 * 9/2002 Pearcy

FOREIGN PATENT DOCUMENTS

CA 2243764 * 1/2000 ..... A01K/1/03

* cited by examiner

*Primary Examiner*—Robert Canfield
(74) *Attorney, Agent, or Firm*—Hugh D. Jaeger

(57) ABSTRACT

A tent for human or animal habitation with a separate pet entrance which offers pets separate entry and exit to and from the interior of the tent at will. The pet entrance offers freedom of movement therethrough in either direction at the pet's discretion followed by automatic closure and sealing of a pet entry door panel against planar panels at the side of the pet entrance.

31 Claims, 6 Drawing Sheets

TENT WITH A PET ENTRANCE

CROSS REFERENCES TO CO-PENDING APPLICATIONS

None.

BACKGROUND OF THE INVENTION

1. Field of the Invention

The present invention is for a tent, and more particularly, relates to a tent generally used to house humans but which has a pet entrance separate from the main entrance.

2. Description of the Prior Art

Portable housings or shelters for animals or pets in the form of a tent structure are known in the prior art; however, no tent structure is known which is for human habitation and has an entrance for pets separate from that of an entrance generally incorporated for entrance of a human or which has a pet entrance that is used solely for entry to or exit from the interior of the tent structure by a pet. Opening of a human entry of a tent in order to allow passage of a pet to or from the interior of the tent can include the opening of multiple components, such as a screen door panel of flexible screen and/or a fabric door panel, and such can often be undesirable in that multiple closure devices such as zippers, ties, or the like must be actuated or manipulated. Also, to allow entry or exit of a pet through the human entry, an entry of extraordinary size with respect to the size of a pet must be opened. Opening of the large human entry, while being laborious, can also expose the interior of the tent for infiltration by insects or rain. Other issues also exist where a pet is housed in a tent and shares the interior of the tent with humans. A pet may track mud or dirt into the tent, thereby soiling the tent floor or other items, such as sleeping bags, clothing and the like; or the pet may even have unwanted access to food items stored in the tent. Pets may also have sharp claws which could puncture the tent floor. Clearly what is needed is a tent for human habitation which overcomes the disadvantages of prior art tents for human habitation by having a separate entrance for a pet, or, alternatively, by having provision for separate kenneling of a pet in a portion of the tent.

SUMMARY OF THE INVENTION

The general purpose of the present invention is to provide a tent with a pet entrance. The tent with a pet entrance includes a tent having support structure, a plurality of side panels, one or more screen panels, a floor, a human entry door panel, a human entry door panel surround, a pet entry door panel surround, a dew barrier, a screen door panel and a separate pet entrance located preferably adjacent to the human entry door panel. The pet entrance includes opposing vertical side panels being triangular in shape, much like door jambs, extending inwardly from a tent panel towards the tent interior, an opening which aligns between the vertical side panels, the tent floor, and an edge or living hinge of a tent panel extending between the tops of the vertical side panels, and a positionable pet entry door panel of tent fabric or other fabric or other material pivoting about the edge or living hinge of the tent panel which extends between the tops of the vertical side panels. A pet can at will gain entrance to or exit the interior of the tent through the pet entrance by simply moving through the pet entrance, whereby the pet entry door panel pivots or is displaced to permit passage of the pet. Subsequent to passage therethrough, gravitational forces cause the pet entry door panel to automatically close. A fastening means, such as a zipper, can also be included for sealing of the positionable pet entry door panel in the closed position, if desired. In the alternative, an integral kennel can extend inwardly from the pet entrance and can include a closeable rear door panel for entrance to the interior of the tent, if required or desired. Also, in the alternative, a plastic rigid wall kennel could align to the rear of the pet entrance.

According to one embodiment of the present invention, there is provided a tent with a pet entrance. A pet entrance preferably is located near one side of the human entry door panel. An opening is provided as part of the pet entrance and includes a pet entry door panel co-located with the opening. The pet entry door panel pivots about a living hinge of a tent panel. The pet entry door panel seals against opposing triangular vertically oriented panels and the floor of the tent.

One significant aspect and feature of the present invention is a tent having a pet entrance separate from a larger entrance for humans.

Another significant aspect and feature of the present invention is a tent with a pet entrance which is self-closing.

Still another significant aspect and feature of the present invention is a tent with a pet entrance which operates without human assistance as a pet enters or exits the tent.

Yet another significant aspect and feature of the present invention is a tent with a pet entrance which can be sealed by a human to contain a pet within or exclude a pet from the interior of the tent.

A further significant aspect and feature of the present invention is a tent with a pet entrance which can include a flexible pet entry door panel of the same material as the general construction of the tent or, in the alternative, can include a pet entry door panel of flexible plastic material.

Alternatively, a still further significant aspect and feature of the present invention is an internally located kennel adjacent to a pet entrance where the kennel can be integral to the construction of the tent or where the kennel can be a plastic rigid wall kennel suitably positioned or attached to the pet entrance.

Having thus described embodiments of the present invention, it is the principal object of the present invention to provide a tent for humans with a separate pet entrance.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENTS

Figure 1:
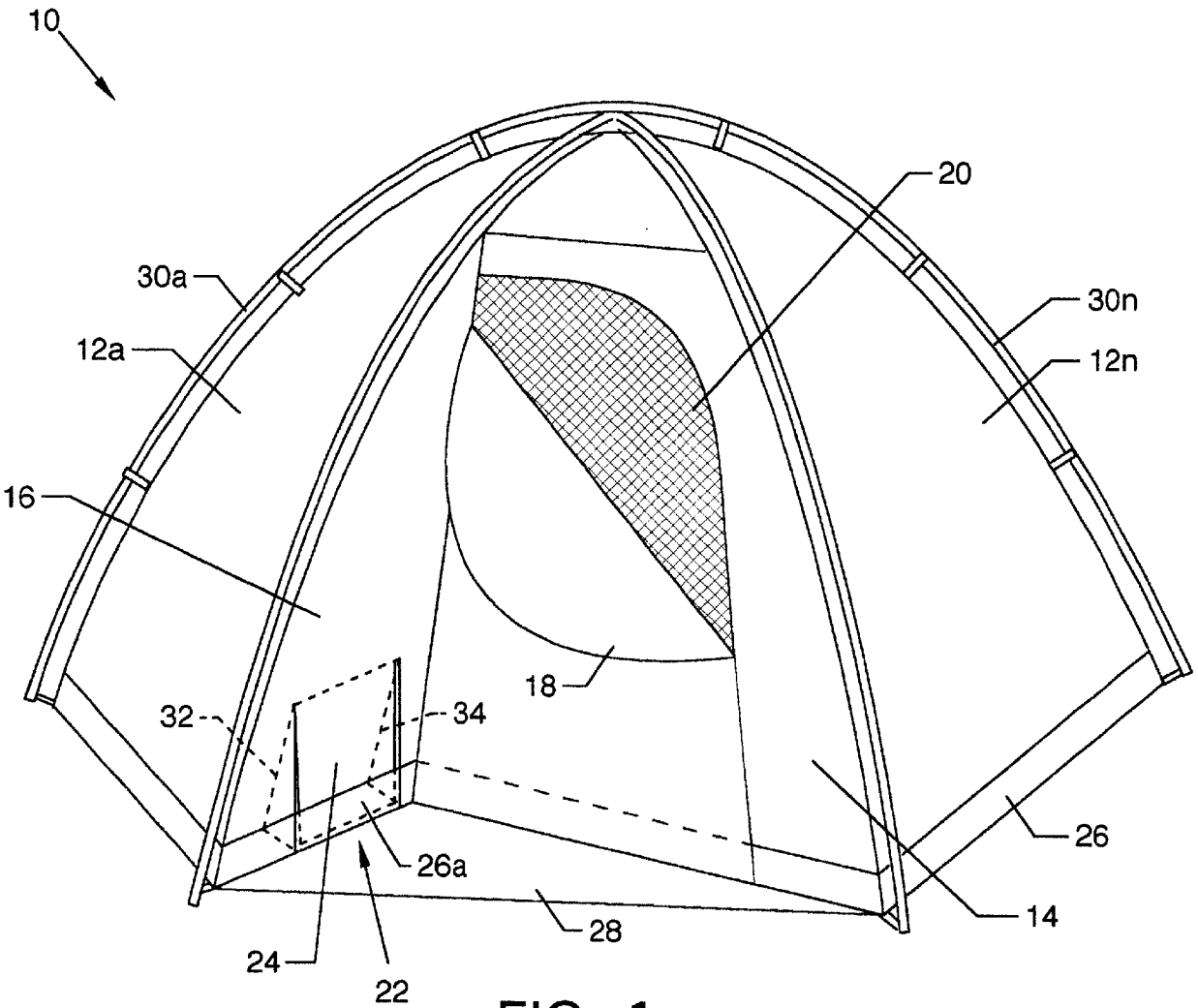
FIG. 1 illustrates a tent with a pet entrance, the present invention.
Figure 2:
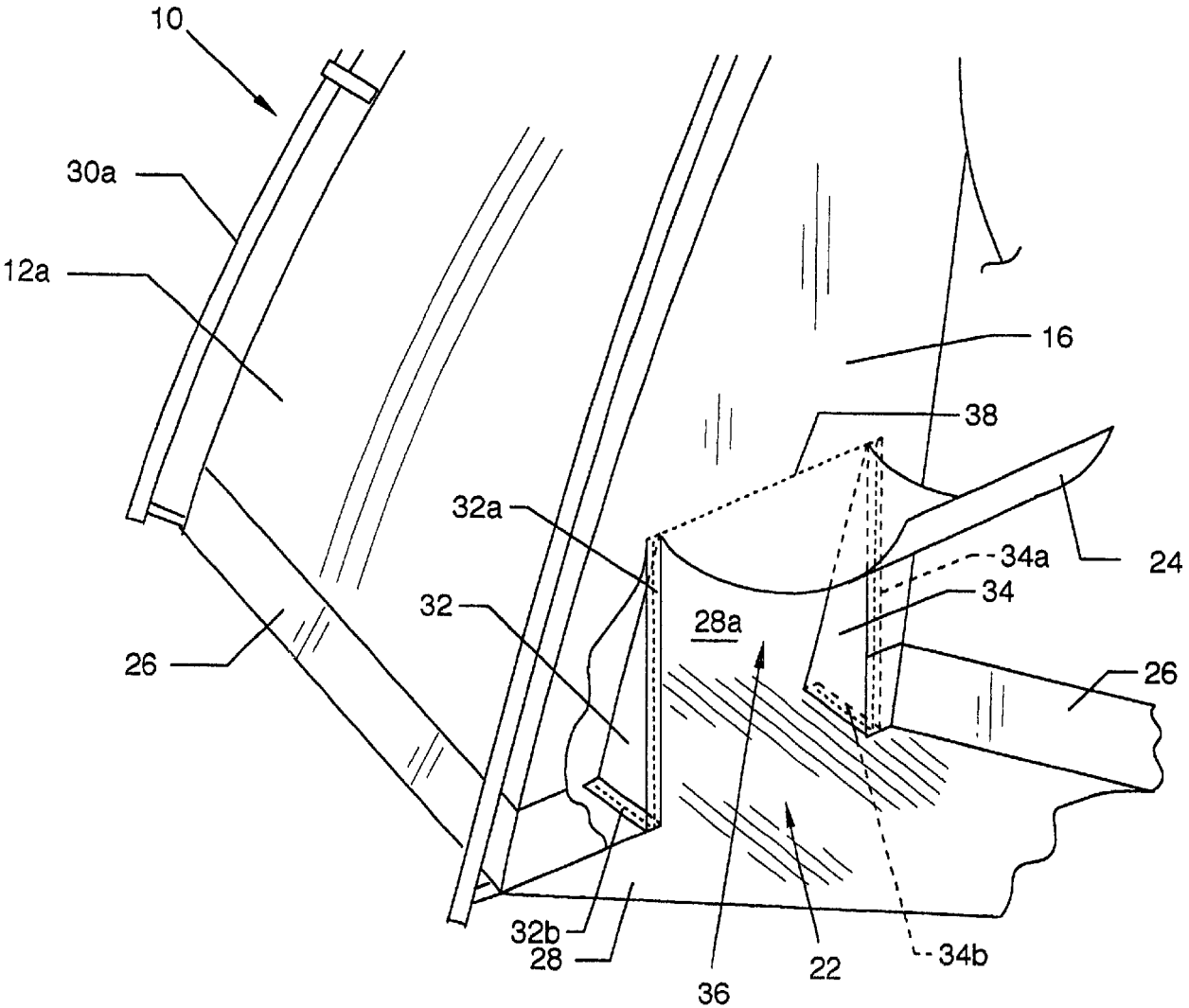
FIG. 2 illustrates a cutaway view of the structure of the pet entrance where the pet entry door panel is shown in actuated position.

FIG. 1 illustrates a tent with a pet entrance 10, the present invention. The tent with a pet entrance 10 is comprised of components including, but not limited to, structures as now described herein. A plurality of full or shortened and connected curved fabric panels 12*a*–12*n* of suitable material adjoin and abut a substantially planar and connected fabric human entry door panel surround 14 and a connected substantially planar and connected fabric pet entry door panel surround 16. A fabric human entry door panel 18 and a co-located screen door panel 20 are located on the human entry door panel surround 14. A pet entrance 22 having a fabric pet entry door panel 24 is located on the pet entry door panel surround 16. A dew barrier 26 is located along and about the lower regions of the curved fabric panels 12*a*–12*n*, the human entry door panel surround 14, and a greater portion of the pet entry door surround panel 16. The dew barrier 26 also extends across and covers the lower region of the screen door panel 20. A dew barrier panel 26*a* fastens to the lower region of the fabric pet entry door panel 24, but does not extend across the opening 36 (FIG. 1). A fabric vestibule 28 is located between and along the lower region of the human entry door panel surround 14 and the lower region of the pet entry door panel surround 16 and extends inwardly as a tent floor 28*a* (FIG. 2). A series of flexible support poles 30*a*–30*n* support the curved fabric panels 12*a*–12*n*, the human entry door panel surround 14, the human entry door panel 18, the screen door panel 20, the pet entry door panel surround 16, and the pet entrance 22.

FIG. 2 illustrates a cutaway view of the structure of the pet entrance 22 where the pet entry door panel 24 is shown actuated and urged into the open position, such as if a pet were exiting the interior of the tent with a pet entrance 10 via the pet entrance 22. Opposing vertically aligned fabric triangular panels 32 and 34, much like door jams, form opposing sides of an opening 36, while the other sides of the opening 36 are bound by the floor 28*a* and by a living hinge 38 extending horizontally along the pet entry door panel surround 16 between the top regions of the triangular panels 32 and 34. The triangular panels 32 and 34 include securing tabs 32*a*, 32*b*, 34*a* and 34*b* extending at an angle therefrom as illustrated, for suitable attachment, such as by stitching, ultrasonic welding or the like, to the floor 28*a* and to the pet entry door panel surround 16, respectively. Erection of the tent with a pet entrance 10 stretches and forms the triangular panels into taut structures against which the pet entry door panel 24 can seal. In the alternative, the triangular panels 32 and 34 can be extendingly formed by the fabric of the pet entry door panel surround 16 in lieu of separate triangular panels. Alternatively, the lower edge of the pet entry door panel 24 can be weighted to maintain the planarity of the pet entry door panel 24 and to maintain vertical orientation of the pet entry door panel 24 for sealing with the adjacent triangular panels 32 and 34. Although the pet entry door panel 24 is suspended from and is an extension of the pet entry door panel surround 16 and acts as a living hinge 38 at the point of extension therefrom, a separate pet entry door panel of increased durability can be substituted and attached to the pet entry door panel surround 16 in the area of the living hinge 38 and shall be deemed to be within the teachings of the invention.

Figure 3:
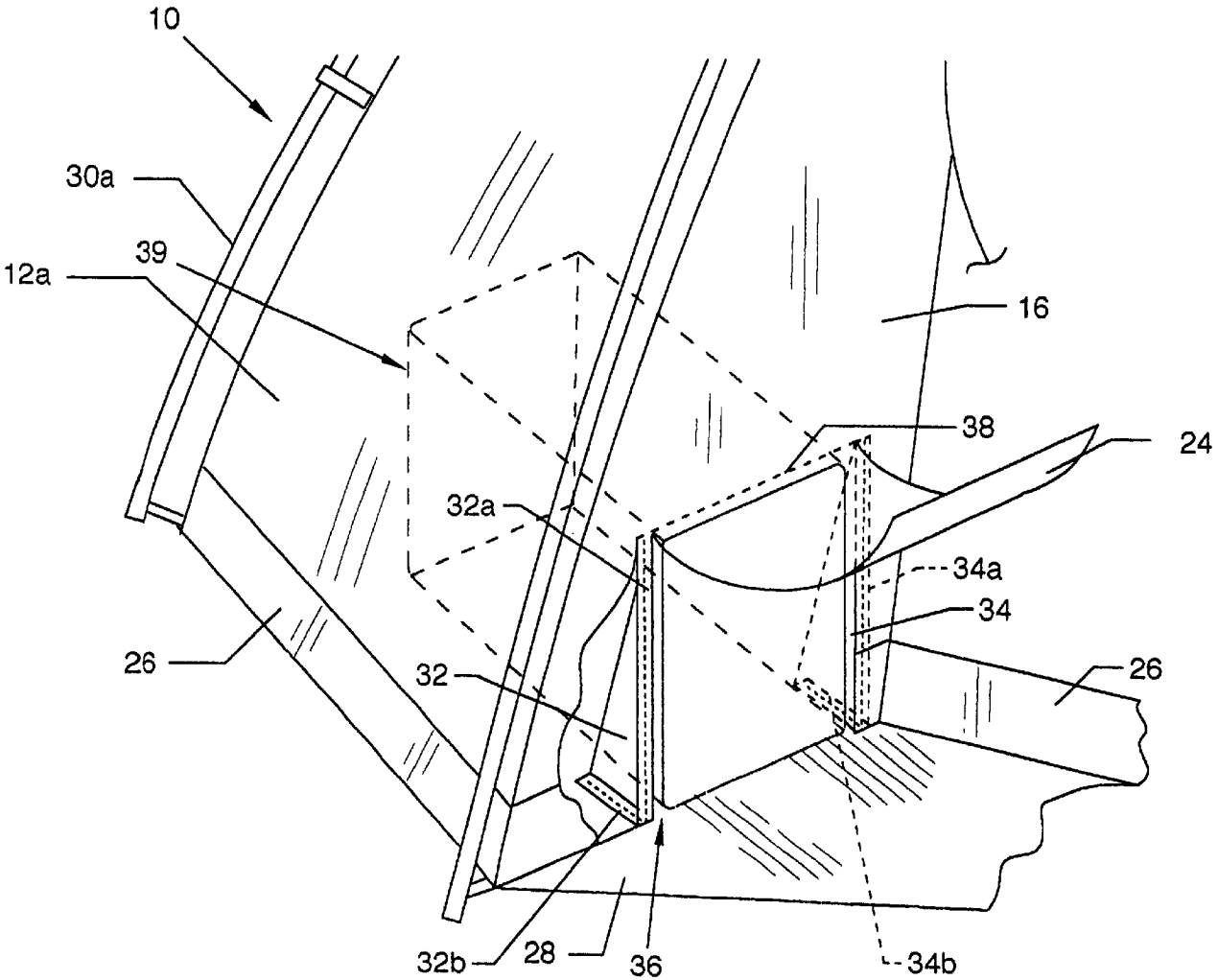
FIG. 3 illustrates the use of a rigid wall kennel with the tent with a pet entrance.

FIG. 3 illustrates the use of a plastic rigid wall kennel 39 with the tent with a pet entrance 10. The rigid wall kennel 39 can be maneuvered through the opening 36 if size permits or it can be maneuvered through the human entry door panel 18 and thence into position in alignment with or behind the opening 36. A wire frame door commonly used with such a rigid wall kennel 39 (not shown) could be removed if desired, whereby the fabric pet entry door panel 24 could be incorporated to allow the pet to displace the pet entry door panel 24 to enter or exit at will. Some pet owners may desire to utilize the rigid wall kennel 39 housed in the tent with a pet entrance 10 to keep the rigid wall kennel 39 and the pet from the elements or may choose to incorporate the use of a wire frame door if free entry and exit is not required. Various securing devices can be incorporated to secure the rigid wall kennel 39 to the structure around and about the opening 36 or to the tent floor 28*a*, as required.

Figure 4:
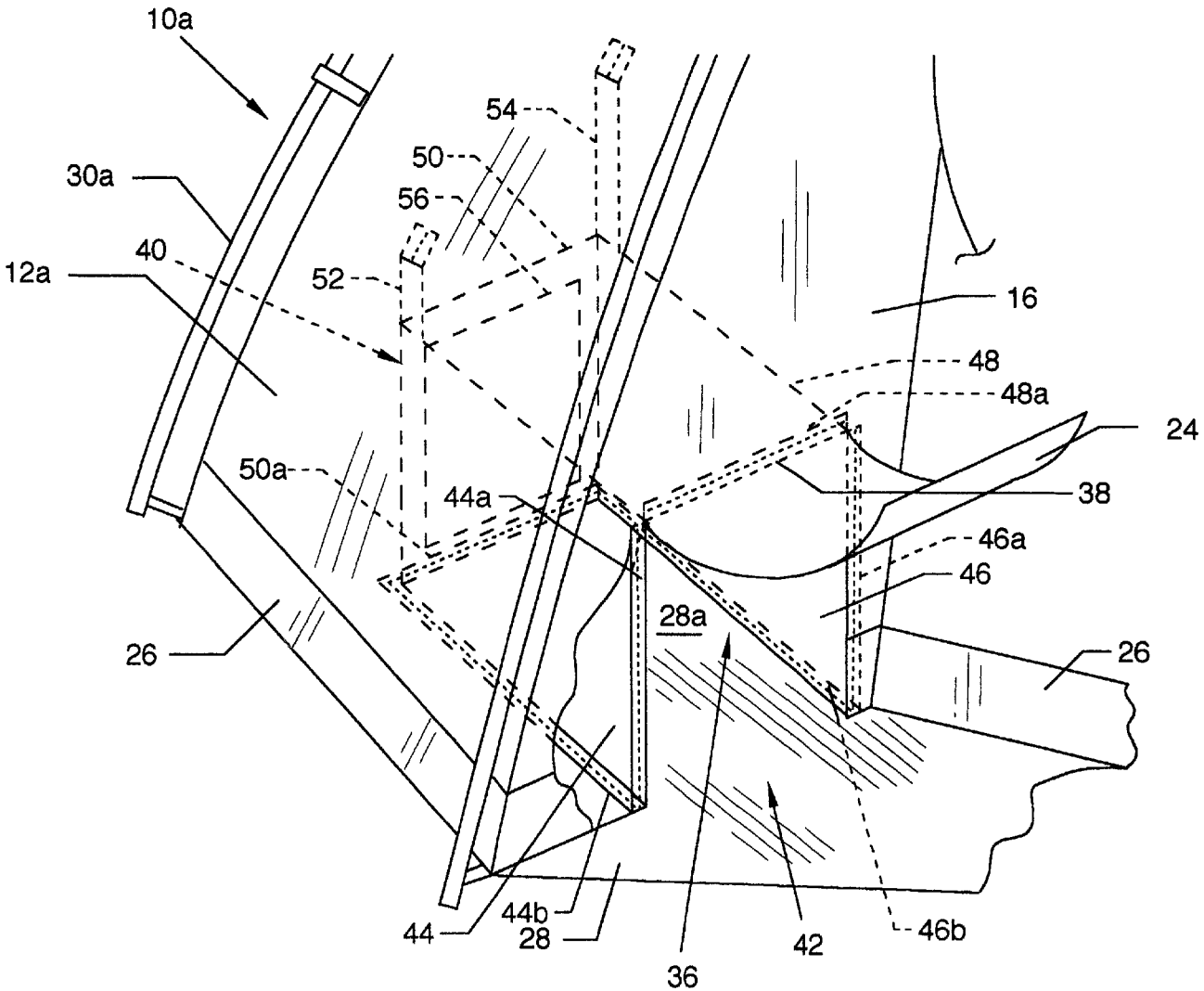
FIG. 4, a first alternative embodiment, illustrates a cutaway view of the structure of a tent with a pet entrance incorporating an integral kennel.

FIG. 4, a first alternative embodiment, illustrates a cutaway view of the structure of a tent with a pet entrance 10*a* incorporating an integral kennel 40 in secured alignment with a pet entrance 42, which is similar in many aspects to the pet entrance 22 previously described. The triangular panels 32 and 34 and their related securing tabs 32*a*, 32*b*, 34*a* and 34*b* of FIG. 2 are replaced by vertically oriented and opposing rectangular fabric side panels 44 and 46 and securing tabs 44*a*, 44*b*, 46*a* and 46*b*, respectively. The rectangular fabric side panels 44 and 46 extend rearwardly from the opening 36 towards the interior of the tent with a pet entrance 10*a* to form opposing sides of the kennel 40. A horizontally oriented rectangular fabric top panel 48 having a securing tab 48*a* secures to and extends from near the living hinge 38 rearwardly between and along the tops of the side panels 44 and 46 and a vertically oriented rectangular fabric rear panel 50 having a lower edge securing tab 50*a* extending downwardly from the rear edge of the top panel 48 along and between the rear edges of the side panels 44 and 46. Securing tabs 44*a*, 46*a* and 48*a* suitably secure such as by stitching, ultrasonic welding or the like to the pet entry door panel surround 16, and the securing tabs 44*b*, 46*b* and 50*a* suitably secure such as by stitching, ultrasonic welding or the like to the floor 28*a*. Vertical support for the rearward and upwardly located portions of the kennel 40 is provided by securing tabs 52 and 54, for purpose of example and illustration, secured to and extending vertically between the upper and rearward corners of the side panels 44 and 46 and the curved fabric panel 12*a*. Alternatively, a fabric rear door panel 56, shown in dashed lines, incorporating a zipper, Velcro®, tabs, buttons or other separable fastening devices can be incorporated so that a pet can gain access to the full interior of the tent with pet entrance 10*a*, if allowed by a human. Although support of the rearward regions of the kennel 40 is provided by securing tabs 52 and 54, other methods of support such as flexible support rods, bungee cords and the like can be incorporated and shall not be deemed to be limiting to the scope of the invention.

Figure 5:
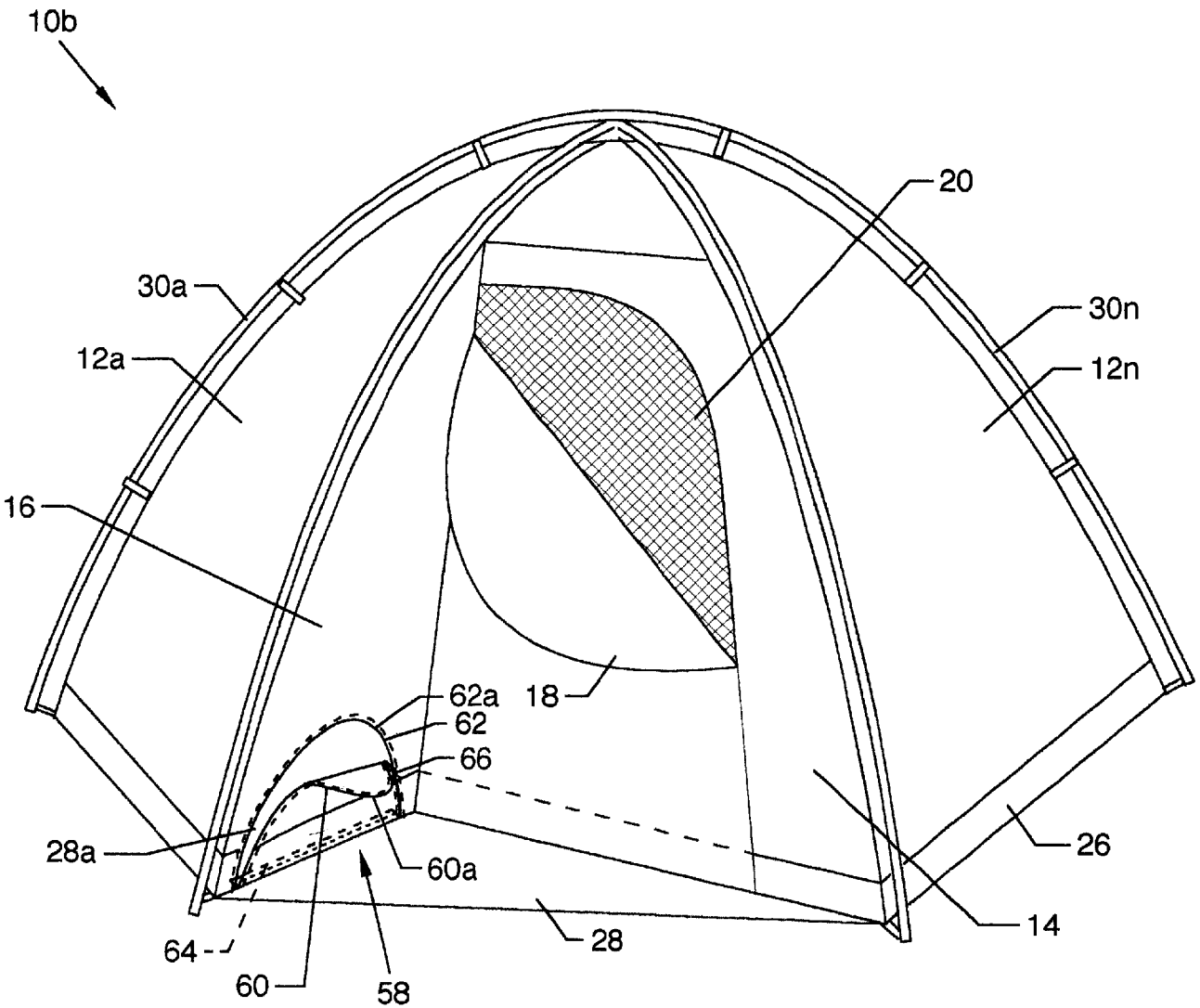
FIG. 5, a second alternative embodiment, illustrates a tent with a pet entrance; and, FIG. 6, a third alternative embodiment, illustrates a tent with a pet entrance and an integral kennel.

FIG. 5, a second alternative embodiment, illustrates a view of the structure of a tent with a pet entrance 10*b* featuring a pet entrance 58, the tent structure of which is similar in many aspects to the tent structure previously described. The pet entrance 58, shown as partially closed or open, is located in the pet entry door panel surround 16 and includes a fabric semi-circular pet entry door panel 60 which mates to a correspondingly sized semi-circular opening 62. The straight lower edge 64 of the semi-circular pet entry door panel 60 suitably secures by stitching, ultrasonic welding or the like to the floor 28*a* or, in the alternative, to the vestibule 28. The lower edge 64 also serves as a living hinge about which the semi-circular pet entry door panel 60 pivots to either lay on the floor 28*a* or the vestibule 28 when not secured to the semi-circular opening 62. Halves of a zipper 66 are located along the edge 62*a* of the semi-circular opening 62 and along the edge 60*a* of the semi-circular pet entry door panel 60 to afford closure and sealing of the semi-circular pet entry door panel 60 to the semi-circular opening 62. In the alternative, other suitable methods of closure such as, but not limited to, VELCRO®, buttons, laces or the like can be incorporated. The semi-circular pet entry door panel 60 and the semi-circular opening 62 are described as being semi-circular in shape, but other geometrically configured and shaped panels and openings having shapes such as, but not limited to, rectangles, squares, triangles, and semi-elliptical can be used.

Figure 6:
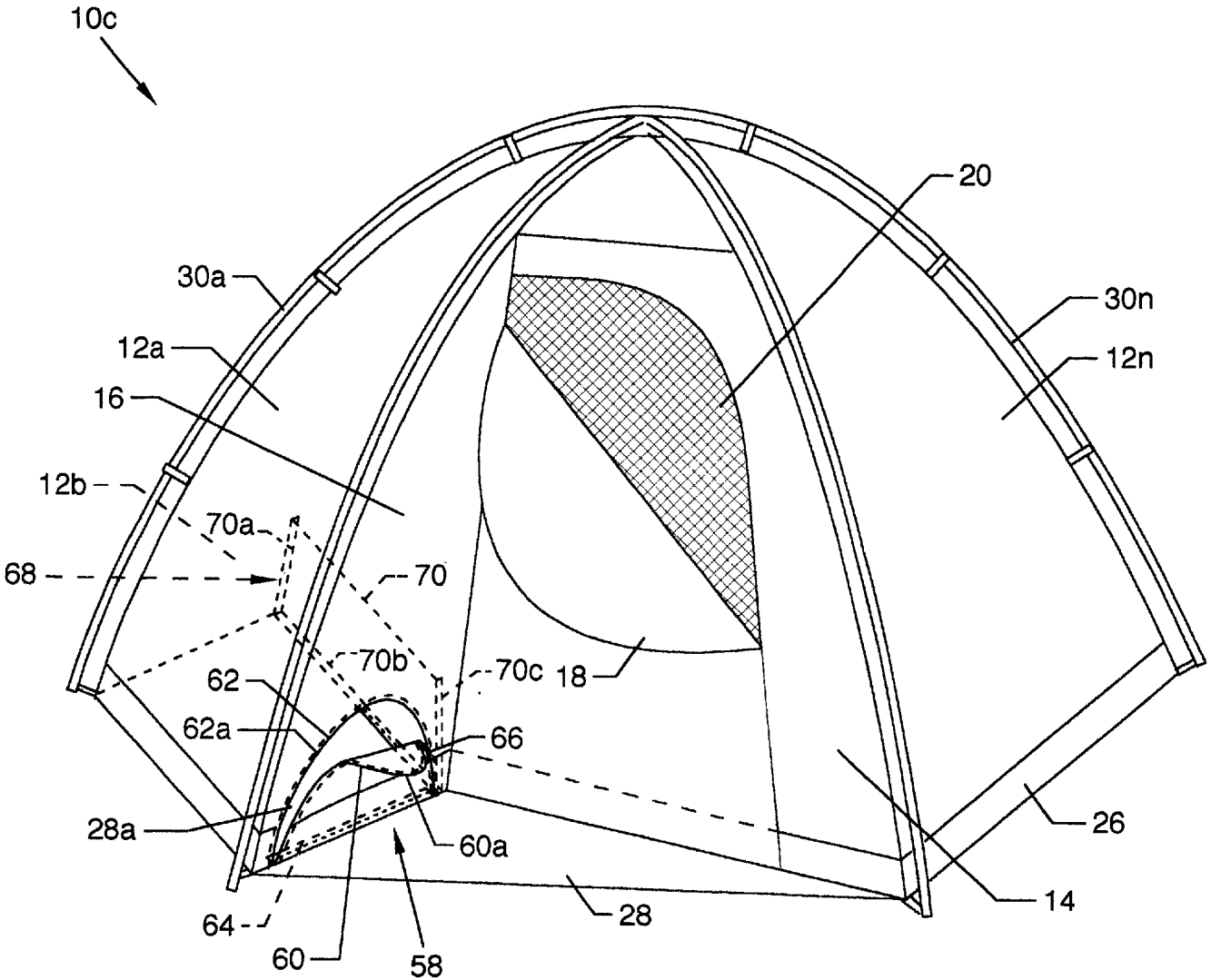

FIG. 6, a third alternative embodiment, illustrates a view of the structure of a tent with a pet entrance 10*c* featuring a pet entrance 58 combined with an integral kennel 68. The tent structure is similar in many aspects to the tent with a pet entrance lob, previously described. A vertically oriented fabric panel 70 having securing tabs 70*a*, 70*b* and 70*c* is secured by stitching, ultrasonic welding or the like to and along the pet entry door panel surround 16 in reasonably close proximity to the pet entrance 58, and thence along and about the floor 28*a* and the curved fabric panel 12*b*. The integral kennel 68 is formed by the panel 70 and the lower portion of the pet entry door panel surround 16, and included entire pet entrance 58, the lower portion of the curved fabric panels 12*a* and 12*b*, and the portion of the floor 28*a* located and bounded by the lower portion of the panel 70 and the lower portions of the pet entry door panel surround 16, and included entire pet entrance 58 and the lower portions of the curved fabric panels 12*a* and 12*b*. Alternatively, the panel 70 can be secured in the locations just described by the use of zippers, VELCRO®, buttons, laces or the like, and can be removable should the use of the kennel 68 not be required. Alternatively, a kennel with a top or a rigid wall kennel can be incorporated.

MODE OF OPERATION

FIG. 2 best illustrates the mode of operation of the present invention. The tent with a pet entrance 10 is first erected for normal use. During erection, the floor 28*a* and curved fabric panels 12*a*–12*n* and the human and pet entry door panel surrounds 14 and 16 are deployed and tensioned to their normal tightness, and as such the structure of the pet entrance 22 is formed. The triangular panels 32 and 34 assume a planar shape, and the living hinge 38 becomes taught and useful for flexible operation of the pet entry door panel 24 thereabout. A pet may enter or exit the pet entrance 22 merely by traversing the opening 36 whilst simultaneously repositioning the pet entry door panel 24 about the living hinge 38. Subsequent to passage, the pet entry door panel 24 with gravitational assistance assumes a planar and vertical closed position with the vertical edges of the pet entry door panel 24 sealingly impinging the planar triangular panels 32 and 34.

FIG. 5 best illustrates the mode of operation of a tent with a pet entrance 10*b* where a zipper 66 can be actuated to either open or close the pet entrance 58.

Various modifications can be made to the present invention without departing from the apparent scope hereof.

PARTS LIST

| | |
|---|---|
| 10 | tent with a pet entrance |
| 10a | tent with a pet entrance |

-continued

PARTS LIST

| | |
|---|---|
| 10b | tent with a pet entrance |
| 12a–n | curved fabric panels |
| 14 | human entry door panel surround |
| 16 | pet entry door panel surround |
| 18 | human entry door panel |
| 20 | screen door panel |
| 22 | pet entrance |
| 24 | pet entry door panel |
| 26 | dew barrier |
| 26a | dew barrier |
| 28 | vestibule |
| 28a | floor |
| 30a–n | support poles |
| 32 | triangular panel |
| 32a–b | securing tabs |
| 34 | triangular panel |
| 34a–b | securing tabs |
| 36 | opening |
| 38 | living hinge |
| 39 | rigid wall kennel |
| 40 | kennel |
| 42 | pet entrance |
| 44 | side panel |
| 44a–b | securing tabs |
| 46 | side panel |
| 46a–b | securing tabs |
| 48 | top panel |
| 48a | securing tab |
| 50 | rear panel |
| 50a | securing tab |
| 52 | securing tab |
| 54 | securing tab |
| 56 | rear door panel |
| 58 | pet entrance |
| 60 | semi-circular pet entry door panel |
| 60a | edge |
| 62 | semi-circular opening |
| 62a | edge |
| 64 | lower edge |
| 66 | zipper |
| 68 | integral kennel |
| 70 | panel |
| 70a–c | securing tabs |

What is claimed is:

1. A tent with a pet entrance comprising:

a. a tent support structure;

b. a plurality of side panels;

c. one or more screen panels, the one or more screen panels connected to the side panels;

d. a floor;

e. a human entry door panel;

f. a human entry door panel surround;

g. a pet entry door panel surround;

h. a dew barrier, the dew barrier located around and about lower regions of the plurality of side panels, the human door entry surround and the pet entry door panel surround;

i. a screen door panel;

j. a separate pet entrance located adjacent to the human entry door panel; and, wherein the plurality of side panels, human entry door panel surround and pet entry door panel surround are connected and supported by the tent support structure, and the floor is connected beneath the side panels, the human entry door panel is carried by the human door entry panel surround and co-located thereon with the screen panel, and the dew barrier is located along and about lower regions of the plurality of side panels, and a pet entry door is carried by the pet entry door surround by a living hinge and further comprising;

k. inwardly extending triangular panels on the pet entry door surround such that the pet entry door closes gravitationally and in contact with the inwardly extending triangular panels.

2. A tent with a pet entrance comprising:

a. a tent support structure;

b. a plurality of side panels;

c. one or more screen panels;

d. a floor;

e. a human entry door panel;

f. a human entry door panel surround;

g. a pet entry door panel surround;

h. a dew barrier;

i. a screen door panel; and, j. a separate pet entrance located adjacent to the human entry door panel, wherein the plurality of side panels, human entry door panel surround, and pet entry door panel surround are connected and supported by the tent support structure above the floor and connected thereto, the human entry door panel is carried by the human door entry panel surround and co-located thereon with the screen panel, the dew barrier is located along and about lower regions of the plurality of side panels, and a pet entry door is carried by the pet entry door surround; and, wherein the pet entrance includes opposing vertical side panels being triangular in shape extending inwardly from a tent panel towards the tent interior, an opening which aligns between the vertical side panels, the tent floor, and an edge or living hinge of a tent panel extending between the tops of the vertical side panels, and a positionable pet entry door panel of tent fabric pivoting about the edge or living hinge of the tent panel which extends between the tops of the vertical side panels, where a pet can enter or exit the interior of the tent through the pet entrance by simply moving through the pet entrance, whereby the pet entry door panel pivots or is displaced to permit passage of the pet, and subsequent to passage therethrough, gravitational forces cause the pet entry door panel to automatically close.

3. A tent comprising:

a. a floor;

b. a plurality of side panels connected to the floor;

c. a human entry door panel surround connected to the floor and to one of the side panels of the, plurality of side panels, the human entry door panel surround carrying a human entry door panel;

d. a pet entry door panel surround connected to the floor and to another of the side panels of the plurality of side panels, wherein the floor, the plurality of side panels, the human entry door panel surround and the pet entry door panel surround together define a flexible and erectable structure;

e. a tent support structure for supporting the flexible and erectable structure in an erected condition; and, f. a pet entry door panel connected to the pet entry door panel surround by a living hinge such that the pet entry door panel is closed by gravity when the erectable structure is supported by the tent support structure.

4. The tent of claim 3, wherein the tent further includes a dew barrier connected to the floor and the plurality of side panels.

5. The tent of claim 4, wherein the dew barrier covers a portion of the plurality of side panels adjacent to the floor.

6. The tent of claim 4, wherein the dew barrier is connected to the human entry door surround.

7. The tent of claim 4, wherein the dew barrier is connected to the pet entry door surround.

8. The tent of claim 3, wherein the tent support structure includes a plurality of tent poles.

9. The tent of claim 8, wherein the tent poles are flexible.

10. The tent of claim 3, wherein the pet entry door panel surround is substantially planar when the erectable structure is supported by the tent support structure.

11. The tent of claim 10, wherein the substantially planar pet entry door panel surround is substantially vertical, relative to the floor, when the erectable structure is supported by the tent support structure.

12. The tent of claim 11, wherein the substantially planar pet entry door surround further includes at least one vertically oriented panel extending into the erected structure when the erectable structure is supported by the tent support structure.

13. The tent of claim 12, wherein the at least one vertically oriented panel is one of a pair of opposed vertically oriented panels extending into the erectable structure.

14. The tent of claim 13, wherein the pair of opposed vertically oriented panels, the floor, and the living hinge, bound the pet entry door panel.

15. The tent of claim 14, wherein the opposed vertically oriented panels are triangular.

16. The tent of claim 15, wherein a side of each of the opposed triangular panels is connected to the pet entry door surround panel and another side of each of the opposed triangular panels is connected to the floor.

17. The tent of claim 13, wherein the opposed vertically oriented panels are substantially rectangular.

18. The tent of claim 17, wherein the substantially rectangular panels partially define an integral kennel within the erectable structure when supported by the tent support structure.

19. The tent of claim 18, wherein the integral kennel further has a rear door panel.

20. The tent of claim 19, wherein the rear door panel of the integral kennel is formed of fabric and is suspended from at least one panel of the plurality of panels.

21. The tent of claim 20, wherein the rear door panel is secured by a temporary fastening selected from the group consisting of zipper, Velcro, tabs, and buttons.

22. The tent of claim 3, wherein the floor extends past the pet entry door surround to serve as vestibule.

23. The tent of claim 3, wherein the human entry door panel surround and the pet entry door panel surround are adjacent.

24. The tent of claim 22, wherein the human entry door panel surround and the pet entry door panel surround are adjacent and the vestibule is shared by the human entry door panel surround.

25. The tent of claim 3, wherein the pet entry door panel is weighted below the living hinge to facilitate gravitational closing.

26. A tent for at least one human and at least one pet comprising:

a. a floor;

b. a human entry door panel surround attached to the floor and a human entry door panel attached to the human entry door panel surround;

c. a pet entry door panel surround attached to the floor and to the human entry door panel surround, with a living hinge, the living hinge being spaced apart from the floor, supporting a pet entry panel;

d. side panel means connected to the floor and to the human entry door panel surround and to the pet entry door panel surround, the floor, human entry door panel surround and pet entry door panel surround together defining a flexible and erectable structure; and, e. tent support means for supporting the erectable structure in an erected condition, such that the pet entry door panel gravitationally closes.

27. The tent of claim 26, wherein the tent support means includes a plurality of tent poles and the side panel means include a plurality of panels attached to the floor and to adjacent panels of the plurality.

28. The tent of claim 26, further comprising at least one panel attached to the pet entry door surround and to the floor, such that swinging of the pet entry door panel on the living hinge causes the pet entry door panel to swing in contact with the at least one panel.

29. The tent of claim 28, wherein the at least one panel is one of a pair of opposed panels attached to the pet entry door surround and the floor such that swinging of the pet entry door panel on the living hinge causes the pet entry door panel to swing in contact with both panels of the pair of opposed panels.

30. The tent of claim 26, wherein the pet entry door panel leads to an integral kennel within the tent.

31. The tent of claim 30, wherein the integral kennel has a rear door situated within the tent.

* * * * *